US009412266B2

(12) United States Patent
Chen et al.

(10) Patent No.: US 9,412,266 B2
(45) Date of Patent: Aug. 9, 2016

(54) SIGNAL CONVERSION DEVICE AND SMART HOME NETWORK SYSTEM USING THE SAME

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Te-Sheng Chen, New Taipei (TW); Xiao-Guang Li, Shenzhen (CN); Kuan-Hong Hsieh, New Taipei (TW); Yun Xiao, Shenzhen (CN); Shang-Hui Pi, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 300 days.

(21) Appl. No.: 14/014,341

(22) Filed: Aug. 29, 2013

(65) Prior Publication Data

US 2014/0085059 A1 Mar. 27, 2014

(30) Foreign Application Priority Data

Sep. 21, 2012 (CN) ..... 2012 1 0352788

(51) Int. Cl.
*G08C 19/16* (2006.01)
*G08C 17/02* (2006.01)
*G08C 23/04* (2006.01)

(52) U.S. Cl.
CPC ..... *G08C 19/16* (2013.01); *G08C 17/02* (2013.01); *G08C 23/04* (2013.01); *G08C 2201/41* (2013.01); *G08C 2201/42* (2013.01); *G08C 2201/93* (2013.01)

(58) Field of Classification Search
CPC ..... G08C 17/02; G08C 19/16; G08C 23/04; G08C 2201/42; G08C 2201/93; G08C 2201/41
USPC ..... 340/12.3
See application file for complete search history.

(56) References Cited

U.S. PATENT DOCUMENTS

2006/0286958 A1* 12/2006 Lee ..... H04B 3/54 455/343.1
2012/0084452 A1* 4/2012 Pettit ..... G08C 17/02 709/230

FOREIGN PATENT DOCUMENTS

CN 102263776 A 11/2011
TW 200838211 A 9/2008

*Primary Examiner* — Nabil Syed
(74) *Attorney, Agent, or Firm* — ScienBiziP, P.C.

(57) ABSTRACT

A smart home network system includes a number of traditional home devices having wireless communication function, a smart gateway, and a plurality of signal conversion devices. When the smart gateway wants to control a traditional home device, the smart gateway sends a cable control signal to a related signal conversion device in the area where the target traditional home device is placed. The related signal conversion device receives the cable control signals from the smart gateway, and converts the cabled control signal into a wireless control signal conforming to the wireless communication function type of the target tradition home device, then transmits the wireless control signal to the target traditional home device. Therefore, the traditional home devices with wireless communication function can be connected into the system, and be controlled by the smart gateway.

7 Claims, 6 Drawing Sheets

SIGNAL CONVERSION DEVICE AND SMART HOME NETWORK SYSTEM USING THE SAME

BACKGROUND

1. Technical Field

The present disclosure relates to smart home technology, and particularly to a signal conversion device and a smart home network system using the signal conversion device.

2. Description of Related Art

Smart home technology is becoming more popular. With this technology, a part of home devices in a house can be connected to a smart home network system, to be controlled by the smart home network system.

However, the home devices applied in existing smart home network system are controlled by wired control signals, which raise a bandwidth requirement. In addition, rewiring for a house is needed when the smart home network system is applied to the house at the first time. As a result of the large number of the home devices and existing wiring, rewiring for a house is difficult, and will destroy existing decoration of the house, and further increase the cost. Further, a part of existing traditional home devices in the house can only receive wireless control signal, and cannot receive cable control signal. Therefore, these traditional home devices cannot be connected to the smart home network system, and cannot be controlled by the smart home network system. It will cause a great waste if a purchase of new home devices needs to replace these traditional home devices.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
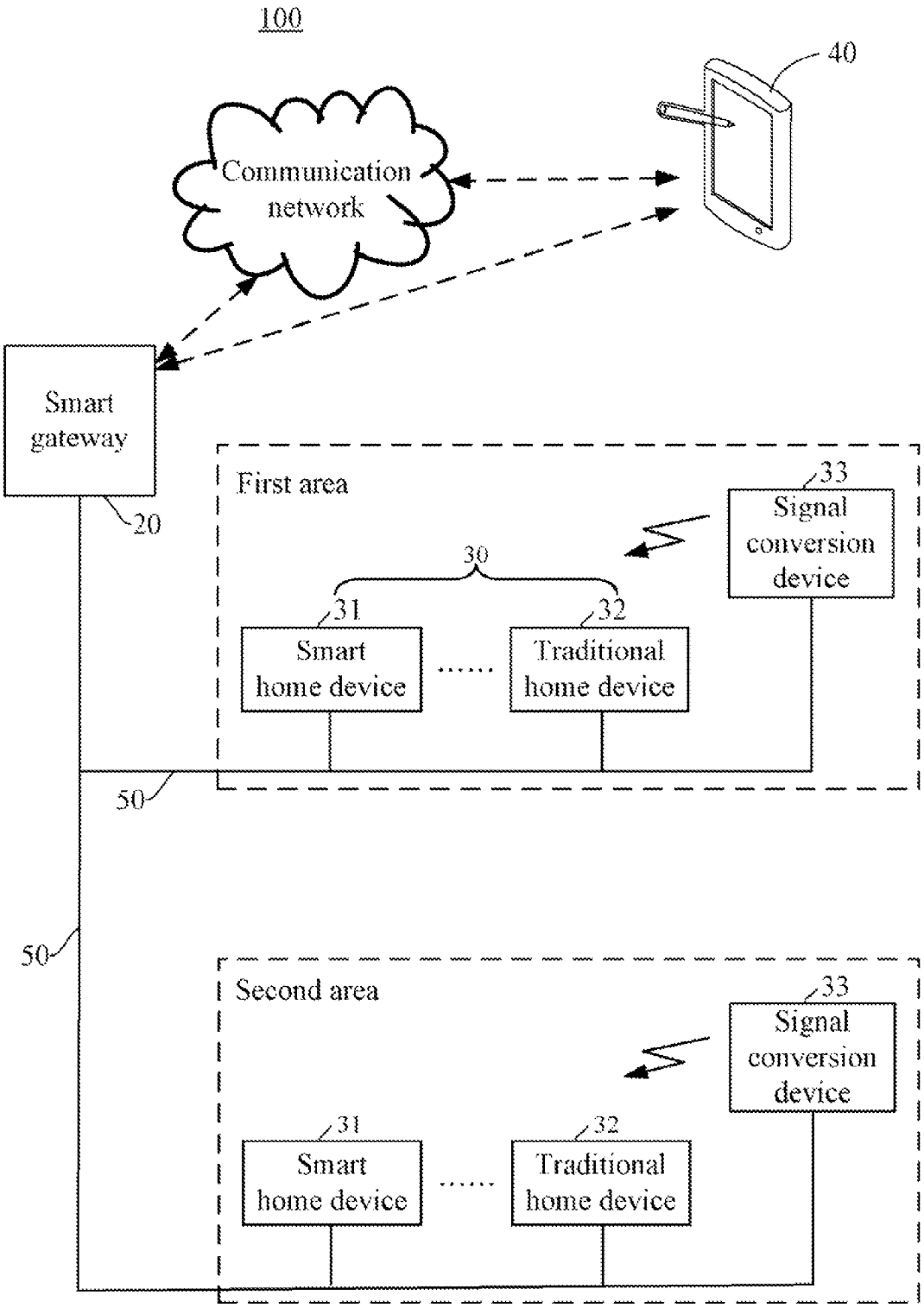
FIG. 1 is a schematic diagram of a smart home network system, according to an embodiment.

FIG. 1 shows a smart home network system 100 of the embodiment. The system 100 includes a smart gateway 20, a number of home devices 30, and a number of signal conversion devices 33. The smart gateway 20 is connected to each home device 30 and the signal conversion devices 33 via power lines 50. The home devices 30 may include, but are not limited to, a refrigerator, an air conditioner, an electric curtain, a lamp, and a smart socket. The home devices 30 include a number of smart home devices 31 and a number of traditional home devices 32. The smart home devices 31 are able to directly communicate with the smart gateway 20 via the power lines. The traditional home devices 32 have wireless communication function, and the smart gateway 20 indirectly communicates with the traditional home devices 32 via the signal conversion device 33.

In this embodiment, each device in the system 100 is provided with a unique identification (UID) code so that it can be uniquely identified by other devices.

Figure 2:
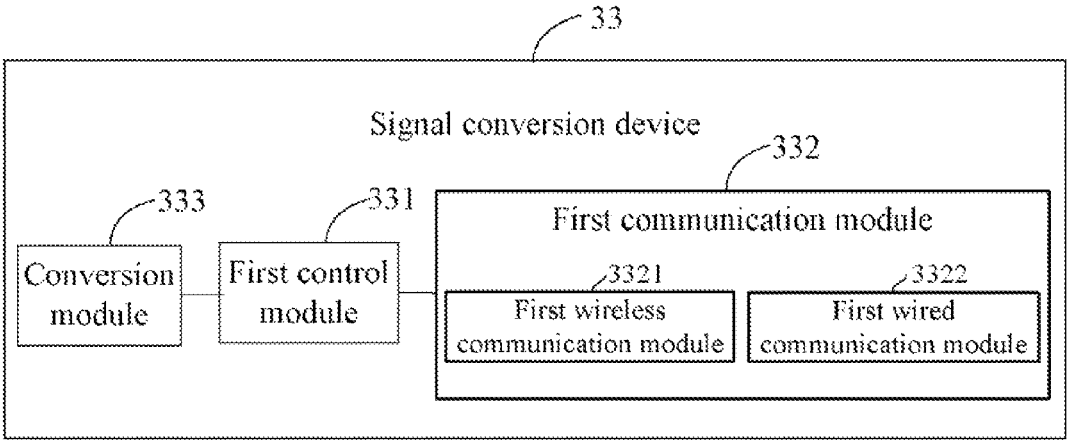
FIG. 2 is a block diagram of a signal conversion device applied in the system of FIG. 1.

Each signal conversion device 33 is placed in a particular area (such as a room or a kitchen) of the house. In this embodiment, the signal conversion device 33 can be contained in a particular home device 30 or placed out of the particular home device 30. FIG. 2 shows that the signal conversion device 33 includes a first control module 331, a first communication module 332, and a conversion module 333. The first communication module 332 includes a first wireless communication module 3321 and a first wired communication module 3322.

Figure 3:
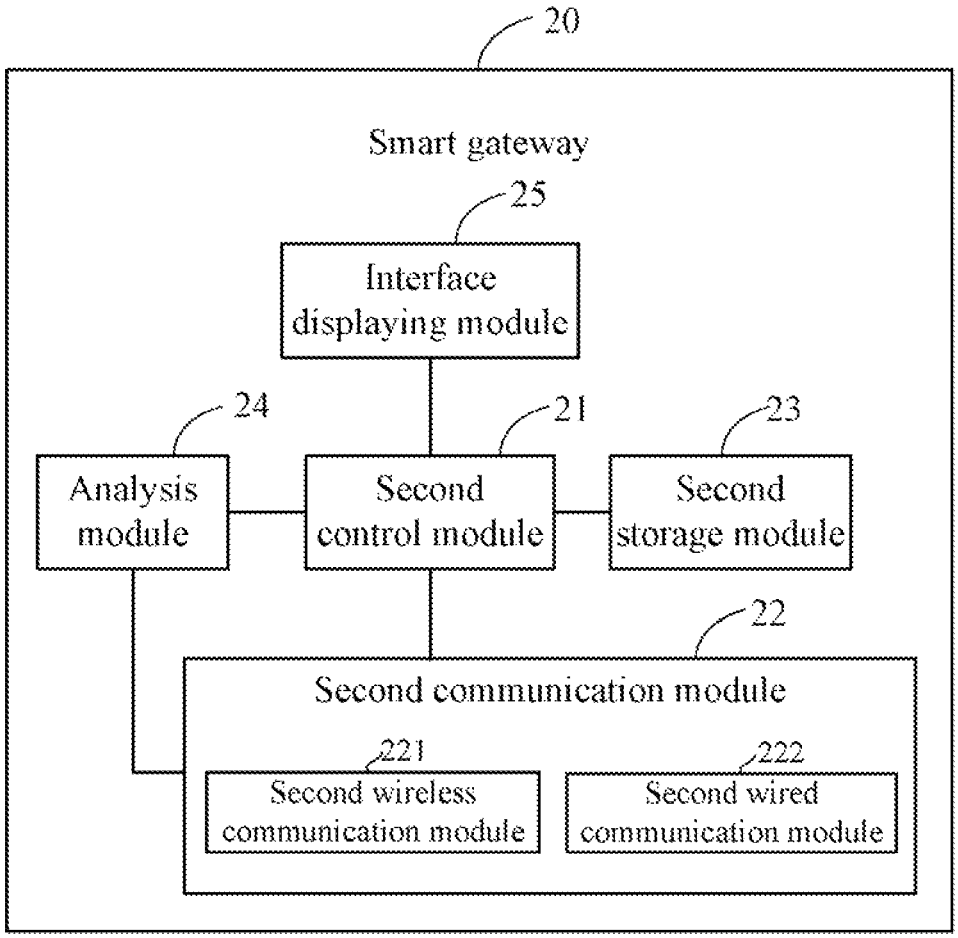
FIG. 3 is a block diagram of a smart gateway applied in the system of FIG. 1.

FIG. 3 shows that the smart gateway 20 includes a second control module 21, a second communication module 22, a second storage module 23, and an analysis module 24. The second storage module 23 stores the UID code of the smart gateway 20 and a mapping list (not shown). The mapping list records the configuration information of each home device 30 and each signal conversion device 33 in the system 100. In this embodiment, the configuration information contains region codes representing areas where the home devices 30 and the signal conversion devices 33 are placed, the UID codes of each home device 30 and each signal conversion device 33, and wireless communication function type of each traditional home device 32. The second communication module 22 includes a second wireless communication module 221 and a second wired communication module 222.

Functions of the above modules of the smart gateway 20 and the signal conversion devices 33 will be described in detail as shown in the following.

All of the smart home devices 31, the second wireless communication module 221 of the smart gateway 20, and the first wireless communication module 3321 of the signal conversion devices 33 are able to emit and receive near field wireless signals. The near field wireless signals may include, but are not limited to, infrared, BLUETHOOTH, Z-wave, NFC, ZigBee, and WIFI signals. In all embodiments of this present disclosure, each of the smart home devices 31, the first wireless communication module 3321, and the second wireless communication module 221 emits and receives infrared signals.

The second wired communication module 222 of the smart gateway 20 is able to communicate with the smart home devices 31 and the first wired communication module 3322 of the signal conversion devices 33 via Power Line Communication (PLC), Optical Fiber Power Line Communication (OPLC), Internet communication, coaxial cable communication, telephone line communication, or other communication technologies. In all embodiments of this present disclosure, the second wired communication module 222 communicates with the smart home devices 31 and the first wired communication module 3322 via PLC or OPLC technologies.

When the smart gateway 20 wants to control a traditional home device 32, the smart gateway 20 sends a cable control signal to a related signal conversion device 33 in the area where the target traditional home device 32 is placed. The related signal conversion device 33 receives the cable control signals from the smart gateway 20, and converts the cabled control signal into a corresponding wireless control signal, then transmits the wireless control signal to the target traditional home device 32.

In the embodiment, FIG. 2 shows that the analysis module 24 reads the UID codes of the target traditional home device 32 and the related signal conversion device 33, and the wireless communication function type of the target traditional home device 32 from the configuration information recorded in the mapping list. The second control module 21 generates the cable control signal for controlling the target traditional home device 32. In this embodiment, the cable control signal contains the UID codes of the target traditional home device 32 and the related signal conversion device 33, and the wireless communication function type of the target traditional home device 32. The second wired communication module 222 modulates the cable control signal and converts network protocols, and then transmits the cable control signal to the related signal conversion device 33 via the power lines 50.

FIG. 3 shows that the first wired communication module 3322 of the signal conversion 33 is connected to the second wired communication module 222 of the smart gateway 20 via the power lines 50. When the first wired communication module 3322 receives the cable control signal transmitted from the smart gateway 20 via the power lines 50, the first wired communication module 3322 demodulates the cable control signal and converts network protocols as required. The conversion module 333 reads the wireless communication function type of the target traditional home device 32 contained in the cable control signal, and converts the cable control signal into the wireless control signal conforming to the wireless communication function type. The first control module 331 reads the UID code of the target traditional home device 32 contained in the cable control signal, and controls the first wireless communication module 3321 to wirelessly transmit the wireless control signal to the target traditional home device 32.

Therefore, the traditional home devices 32 with wireless communication function can be connected into the system 100, and be controlled by the smart gateway 20.

In this embodiment, each home device 30 and each signal conversion device 33 needs to register its configuration information with the smart gateway 20, when the home device 30 or the signal conversion device 33 is connected to the system 100 for the first time or is re-connected to the system 100, to allow the smart gateway 20 to obtain the configuration information of each home device 30 and each signal conversion device 33, then to control each home device 30.

Figure 4:
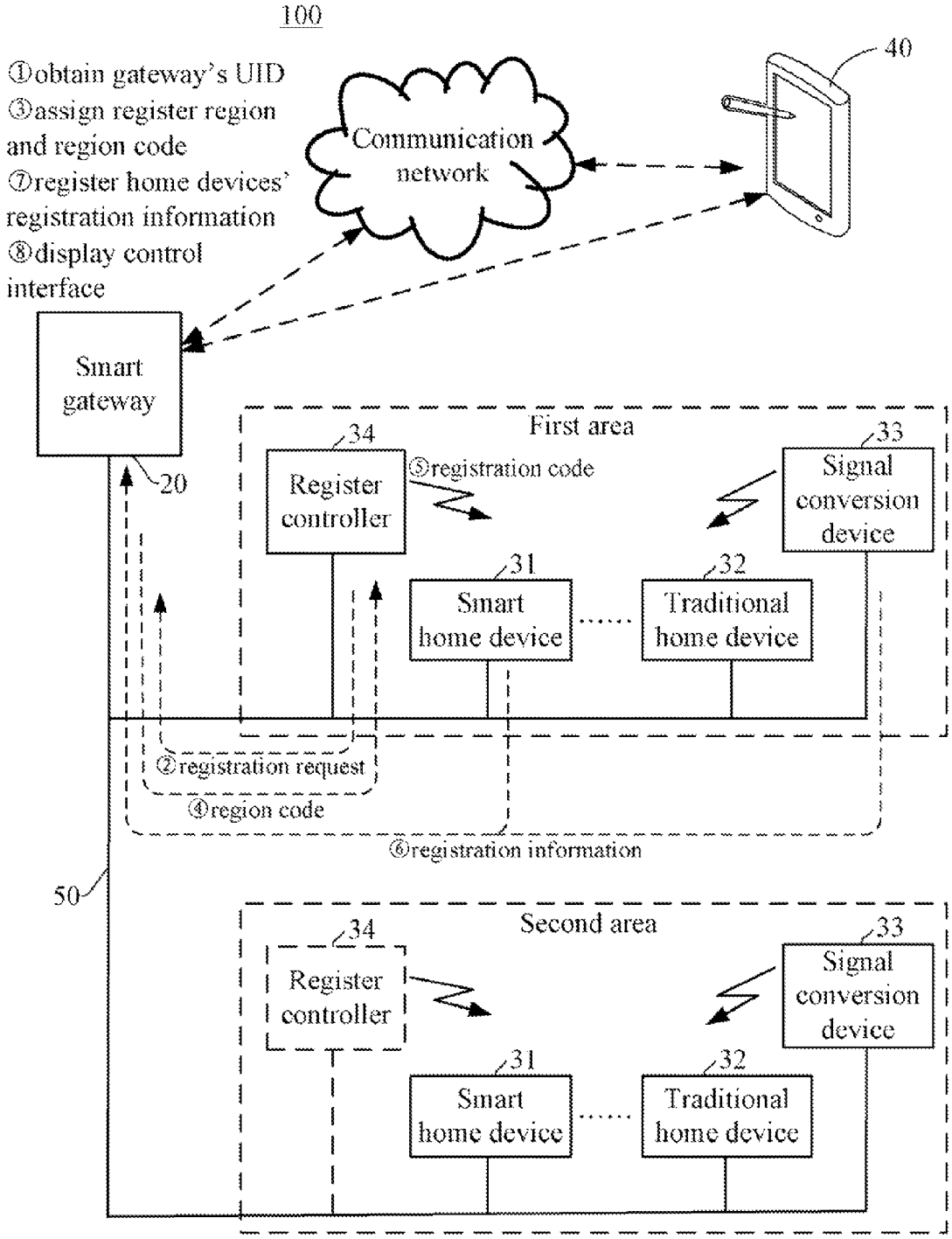
FIG. 4 is a flowchart illustrating a method for registering a number of home devices and signal conversion devices applied in the system of FIG. 1 with the smart gateway of FIG. 3.

FIG. 4 shows that the system 100 further includes at least one register controller 34, each of which can be placed in a particular area (such as a room or a kitchen) of the house, and be connected to the smart gateway 20 via the power lines 50. In this embodiment, the register controller 34 can be contained in a particular home device 30 in the area or placed out of the particular home device 30. Each register controller 34 controls all of the home devices 30 and the signal conversion devices 33 in the particular area where the register controller 34 is placed to register their configuration information with the smart gateway 20.

Figure 5:
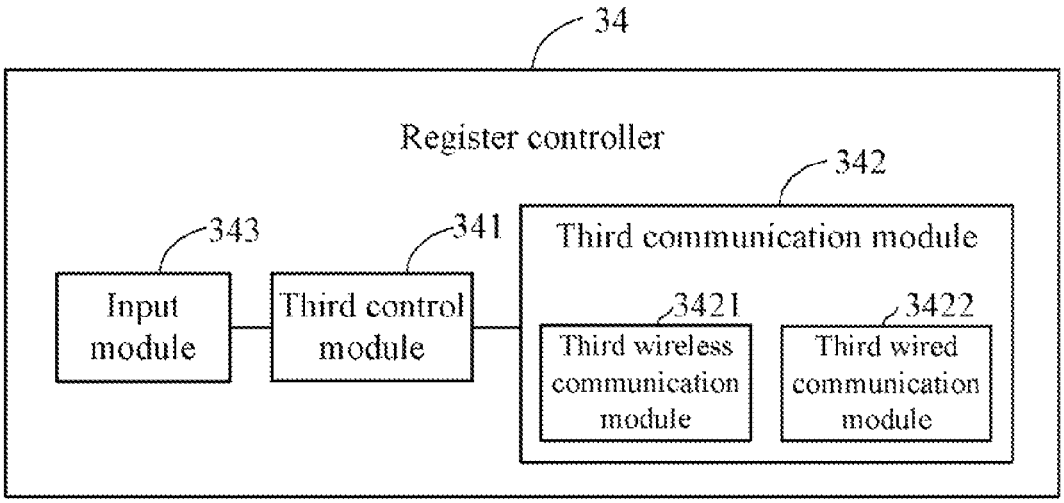
FIG. 5 is a block diagram of a register controller applied in the system of FIG. 4.

FIG. 5 shows that the register controller 34 includes a third control module 341, a third communication module 342, and an input module 343. The input module 343 is a button or a touch screen on the register controller 34 configured to allow a user to input information. The third communication module 342 includes a third wireless communication module 3421 and a third wired communication module 3422. The register controller 34 is able to wirelessly communicate with the second wireless communication module 221 of the smart gateway 20 via the third wireless communication module 3421, or communicate with the second wired communication module 222 of the smart gateway 20 via PLC or OPLC technology. In this embodiment, the third wireless communication module 3421 is able to emit and receive infrared signals.

Referring again to FIG. 4, a method for registering the home devices 30 and the signal conversion devices 33 in the system 100 with a smart gateway 20 is illustrated.

In step 1, the register controller 34 obtains the UID code of the smart gateway 20 via the third wireless communication module 321.

In this embodiment, the gateway 20 initiates a registration process, and the second control module 21 controls the second wireless communication module 221 to send out the UID code of the gateway 20. Because the wireless technology employed is infrared transmission, the register controller 34 is carried closer to the smart gateway 20, such that the register controller 34 is within range of the infrared signal.

In step 2, the register controller 34 is carried to a particular area, such as a first area, and is connected to the system 100. The third control module 341 of the register controller 34 generates a registration request in response to an input via the input module 343. The third control module 341 controls the third wired communication module 3422 to send the registration request to the smart gateway 20 via the power lines 50.

In this embodiment, the registration request contains the UID code of the smart gateway 20 and the UID code of the register controller 34.

In step 3, when the second wired communication module 222 of the smart gateway 20 receives the registration request from the register controller 34, the second control module 21 assigns a register region and a region code in the mapping list for the home devices 30 and the signal conversion device 33 placed in the first area.

In a first embodiment, the at least one register controller 34 includes a number of register controller 34, each of which is placed in a particular area in the house. The second control module 21 of the smart gateway 20 assigns the UID code of the register controller 34 that sends out the registration request as the region code for the home devices 30 and the signal conversion device 33 placed in the first area. In a second embodiment, the at least one register controller 34 includes only one register controller 34, which can be moved to different areas of the house at different times. The second control module 21 of the smart gateway 20 assigns the region code according to a number or an order of the received registration requests, for example.

In step 4, the second wired communication module 222 of the smart gateway 20 sends the region code back to the register controller 34 that sent out the registration request via the power lines 50.

In step 5, when the third wired communication module 3422 of the register controller 34 received the region code, the third control module 31 generates a registration code that contains the region code and the UID code of the smart gateway 20, and the third wireless communication module 3421 wirelessly sends the registration code to all of the home devices 30 and the signal conversion device 33 placed in the first area.

In step 6, when the smart home devices 31 and the signal conversion device 33 placed in the first area received the registration code from the register controller 34, the smart home devices 31 and the signal conversion device 33 send their registration information to the smart gateway 20 via the power lines 50.

In this embodiment, the registration information contains the UID code of the smart gateway 20, the region code, and the configuration information of the home devices 30 or the signal conversion device 33.

In a third embodiment, the second control module 21 of the smart gateway 20 further generates an enquiry message that contains the region code, and controls the second wired communication module 222 to send the enquiry message to all of the home devices 30 and the signal conversion devices 33 in the system 100 via the power lines 50. The enquiry message is a signal that is used to distinguish the home devices 30 and the signal conversion device 33 that have received the registration code sent by the register controller 34, that is, to distinguish which home devices 30 and which signal conversion device 33 are in the same area as the register controller 34 that sent out the registration request. When the home devices 30 and the signal conversion device 33 received the enquiry message from the smart gateway 20 and received the registration code from the registration controller 34, the home devices 30 and the signal conversion device 33 determine whether or not the region code contained in the received enquiry message is the same as the region code contained in the registration code. If the region code contained in the received enquiry message matches the region code contained in the registration code, the home devices 30 and the signal conversion device 33 send their registration information to the smart gateway 20.

In step 7, when the second wired communication module 222 of the smart gateway 20 receives the registration information from the home devices 30 or the signal conversion device 33, the second control module 21 registers the configuration information in the corresponding register region in the mapping list. Therefore, the configuration information of the home devices 30 and the signal conversion device 33 placed in the same area is registered in the same register region in the mapping list.

Due to the traditional home devices 32 are not able to send back their configuration information to the smart gateway 20 or the signal conversion device 33, user can manually input the configuration information of the traditional home devices 32 to a corresponding register region in the mapping list.

If a new home device 30 is added to a registered area (that is, the registration information of the home devices in the area have been registered in the mapping list of the smart gateway 20) and needs to be registered with the smart gateway 20, the process repeats steps 2-7 again.

It should be noted that, due to the UID code of each home device 30 being unique, the registration information of each home device 30 will only be registered once in the mapping list. If a home device 30 is moved to a new area, the registration information of the home device 30 registered in an original register region in the mapping list will be deleted, and the registration information will be registered in a new register region in the mapping list.

The registration process for other home devices 30 placed in other areas is similar to steps 1-7.

Figure 6:
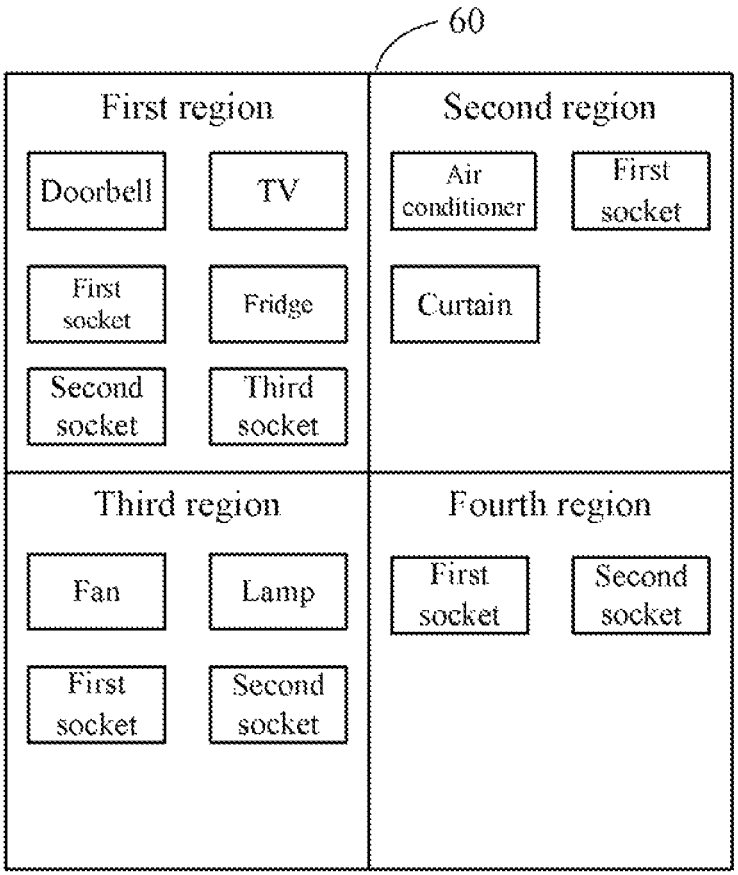
FIG. 6 is a schematic diagram of a control interface displayed on the smart gateway of FIG. 3 or on a control device.

In step 8, the smart gateway 20 displays a control interface 60 (as shown in FIG. 6) according to the mapping list. In this embodiment, the control interface 60 includes a number of regions corresponding to the areas in the house. Each region includes a number of icons corresponding to the home devices 30 and the signal conversion device 33 placed in a corresponding area in the house.

Referring also to FIG. 2, the smart gateway 20 further includes an interface displaying module 25, the interface displaying module 25 displays a schematic diagram of the regions according to the region codes of the mapping list, and displays the icons of the home devices 30 and the signal conversion devices 33 in corresponding regions according to their corresponding UID codes and the region codes registered in the mapping list.

Such that, the registration process of the home devices 30 and the signal conversion devices 33 with the smart gateway 20 is completed.

The system 100 further includes a control device 40. The control device 40 may be selected from a group consisting of a smart phone and a tablet computer. The smart gateway 20 is connected to a communication network, and communicates with the control device 40 via wired communication technology or wireless communication technologies. The control device 40 displays the control interface 60 according to the mapping list stored in the smart gateway 20, and the smart gateway 20 receives control signals for controlling target home devices from the control device 40, and sends the control signals to the target home devices. Therefore, the system 100 allows a user to operate the control device 40 in his hands to remotely control any target home device at anywhere and anytime.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A smart home network system comprising a plurality of traditional home devices having wireless communication function, a smart gateway, and a plurality of signal conversion devices, each of the signal conversion device comprising:

a first wired communication module configured to receive a cable control signal for controlling a target traditional home device from the smart gateway, wherein the cable control signal contains a UID code and a wireless communication function type of the target traditional home device;

a conversion module configured to read the wireless communication function type of the target traditional home device contained in the cable control signal, and converts the cable control signal into a wireless control signal conforming to the wireless communication function type;

a first wireless communication module configured to wirelessly transmit the wireless control signal to the target traditional home device; and the smart gateway comprising:

a storage module storing a mapping list, wherein the mapping list records configuration information of each traditional home device and each signal conversion device in the system, and the configuration information contains region codes representing areas where the home devices and the signal conversion devices are placed, UID codes of each home device and each signal conversion device, and wireless communication function type of each traditional home device;

an analysis module configured to read the UID codes of the target traditional home device and a related signal conversion device in the area where the target traditional home device is placed, and the wireless communication function type of the target traditional home device from the configuration information recorded in the mapping list;

a control module configured to generate the cable control signal for controlling the target traditional home device, wherein the cable control signal further contains a UID code of the related signal conversion device; and a second wired communication module configured to transmit the cable control signal to the related signal conversion device.

2. The system as described in claim 1, wherein the smart gateway is connected to the signal conversion devices via power lines, and the first wired communication module of the signal conversion device communicates with the second wired communication module of the smart gateway via PLC or OPLC technologies.

3. The system as described in claim 2, wherein the second wired communication module modulates the cable control signal and converts network protocols, and then transmits the cable control signal to the related signal conversion device via the power lines; the first wired communication module receives the cable control signal from the smart gateway via the power lines, and demodulates the cable control signal and converts network protocols as required.

4. The system as described in claim 1, wherein the first wireless communication module of the signal conversion device is able to emit and receive near field wireless signals, wherein the near field wireless signal is selected from a group consisting of infrared, Bluetooth, Z-wave, NFC, ZigBee, and WIFI signals.

5. The system as described in claim 1, wherein the system further comprises a register controller;

the smart gateway receives a registration request from the register controller, and obtains registration information of the traditional home devices and the signal conversion device located in a same region as the register controller, the registration request contains the UID code of the smart gateway and the UID code of the register controller, the registration information contains configuration information of the home devices and the signal conversion device; and the smart gateway assigns a region code for the traditional home devices and the signal conversion device located in the same region as the register controller in response to the received registration request, and sends the region code back to the register controller, enabling the register controller to generate a registration code and send the registration code to the traditional home devices and the signal conversion device located in the region as the register controller, the registration code contains the region code and the UID code of the smart gateway.

6. The system as described in claim 5, wherein the smart gateway generates an enquiry message that contains the region code to the traditional home devices and the signal conversion device, the enquiry message is used to distinguish the home devices 30 and the signal conversion device that have received the registration code sent by the register controller.

7. The system as described in claim 6, wherein if the region code contained in the received enquiry message matches the region code contained in the registration code, the home devices and the signal conversion device send their registration information to the smart gateway.

* * * * *